United States Patent [19]

Wagner et al.

[11] Patent Number: 4,843,376

[45] Date of Patent: Jun. 27, 1989

[54] BOAT DRAIN PLUG WARNING APPARATUS

[76] Inventors: Leland J. Wagner, 601 S. Commercial, Emporia, Kans. 66801; Harry E. O'Mara, Route 2, Box 100, Reading, Kans. 66868

[21] Appl. No.: 180,311

[22] Filed: Apr. 11, 1988

[51] Int. Cl.[4] ..... G08B 21/00

[52] U.S. Cl. ..... 340/568; 114/197; 340/540; 340/610

[58] Field of Search ..... 340/568, 610, 540; 114/197, 270

[56] References Cited

U.S. PATENT DOCUMENTS 4,542,373 9/1985 Hillock ..... 340/686

*Primary Examiner*—Glen R. Swann, III

*Attorney, Agent, or Firm*—Kokjer, Kircher, Bradley, Wharton, Bowman & Johnson

[57] ABSTRACT

A plastic paddle is pivotally connected to the operating arm of a microswitch. The paddle is positioned in front of a boat's drain opening. The paddle can be swivelled to one side to allow removal of the boat's drain plug. When the plug is removed and the paddle lies in front of the drain opening, if the boat is launched without replacing the drain plug, the inrushing water will move the paddle so as to close the microswitch and actuate an alarm. Enough of the drain hole is left uncovered by the paddle to allow water to drain out of the boat.

5 Claims, 1 Drawing Sheet

BOAT DRAIN PLUG WARNING APPARATUS

FIELD OF THE INVENTION

This invention relates generally to boat safety and deals more particularly with means for providing those in the process of launching a boat with warning that the drain plug is not present in the drain opening.

BACKGROUND OF THE INVENTION

It is common practice in boating to remove boats from the water at the conclusion of the boating activity, either for transport of the boat to a different location, or for dry storage on the beach, a boat hoist or boat trailer. In these boats with drain openings in the transom, it is also common practice when the boat is taken out to remove the drain plug from the drain opening. This permits any water which has collected in the interior of the boat to drain away. It is also common to leave the drain opening unplugged while the boat is out of the water, so as to permit drainge of any additional water, such as rain water, that might otherwise collect if the drain were plugged.

It not infrequently happens that when the boat is next launched, the insertion of the plug into the drain opening has been overlooked. As a consequence, as the boat enters the water, water flows inwardly through the drain opening and begins to fill the boat. If not checked, it is possible for the boat to sink. At the least, damage to components and possessions by flooding can occur, to say nothing as to the embarrassment of the owner or operator.

SUMMARY OF THE INVENTION

Our invention solves the foregoing problems by providing a simple and reliable mechanism which operates to provide the boat operator with an immediate warning as the boat enters the water that the drain opening is open. In the preferred form of the invention, the warning is by an audible, battery-actuated horn or buzzer which is actuated in response to a sensor mechanism which detects the commencement of water flow into the boat through the drain opening. The operator is thus motivated to halt the launching process immediately and to take steps necessary to make sure that the boat is fully drained and to accomplish the insertion of the drain plug.

Among features of our invention which make it attractive to a vast part of the boat population is the ability to produce it at a relatively low cost; its ready adaptability to a wide variety of boats with a minimum of installation costs or problems; the fact that it requires no alterations to be made in the boat or the drain plug structure and operation; the sensitivity it provides to quick detection of the problem while not interfering with insertion or removal of the drain plug; and its overall simplicity in construction and operation.

BRIEF DESCRIPTION OF THE DRAWINGS

In the accompanying drawings, which form a part of the specification and are to be read in conjunction therweith, and in which like reference numerals indicate like parts in the various views.

DESCRIPTION OF THE PREFERRED EMBODIMENT

Figure 1:
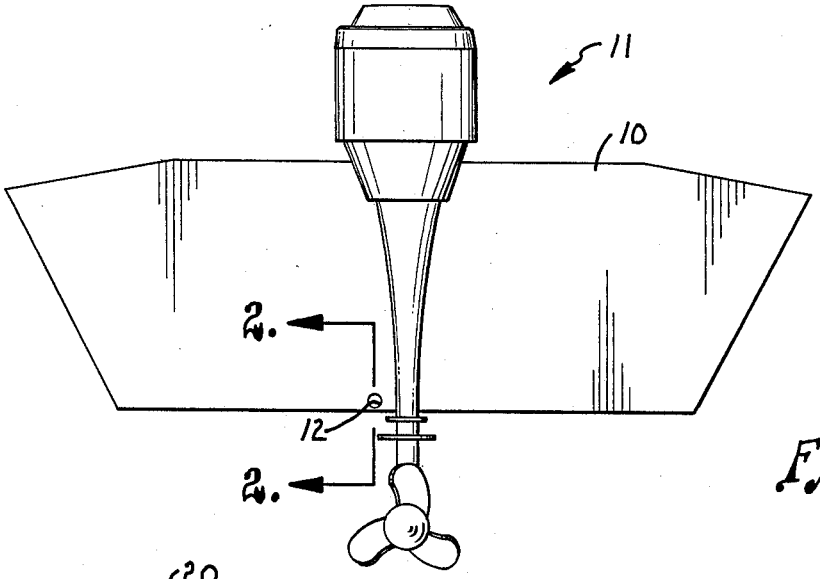
FIG. 1 is a rear elevational view of a typical outboard motor boat illustrating a drain opening.

Referring to the drawings, in FIG. 1 the outside surface of the boat transom is indicated at 10 and a typical outboard motor at 11. The invention is not, however, in any way limited to outboard motor boats but may be utilized with any boat having the potential for launching with an unplugged drain which permits incursion of water during the launching process.

The drain opening is shown at 12, being usually located at the inside base of the transom 10.

Figure 2:
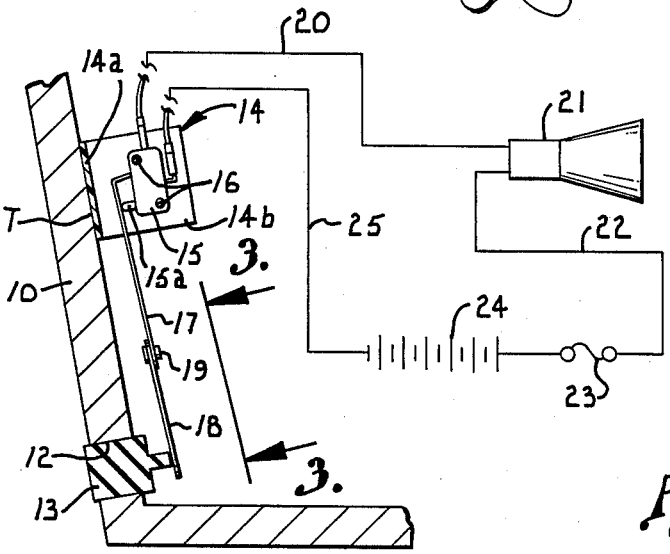
FIG. 2 is a fragmentary sectional view, on an enlarged scale, taken along line 2—2 of FIG. 1 in the direction of the arrows and including a schematic diagram of the electrical support end warning system.

As shown in FIG. 2 the drain opening 12 receives a drain plug 13 which in most cases is designed for insertion into the drain opening from the inside of the boat. However, as will be seen, the invention will work equally well in situations where the drain is closed from the outside.

Connected to the outside wall of the transom 10 and located generally directly above the drain opening is a mounting bracket 14. The bracket is L-shaped, having the base leg **14*a* positioned adjacent to transom and the leg 14*b* projecting outwardly. The bracket 14 is preferably made of plastic and leg 14*a*** is secured to the transom surface by a double-faced adhesive tape T interposed therebetwen. Other methods of connection can, however, be used.

The projecting leg **14*b* serves as a mounting surface for an electric microswitch 15. The switch is of conventional construction, having the plunger 15*a* which is internally spring biased outwardly. With the plunger in the "out" position the switch is off. The switch is secured to the bracket leg 14*b* by screws 16**, or in any other convenient manner.

Pivotally connected with switch 15 is one end of an actuator arm 17. Arm 17 extends over the outer end of switch plunger **15*a*** and downwardly toward the drain opening.

Figure 3:
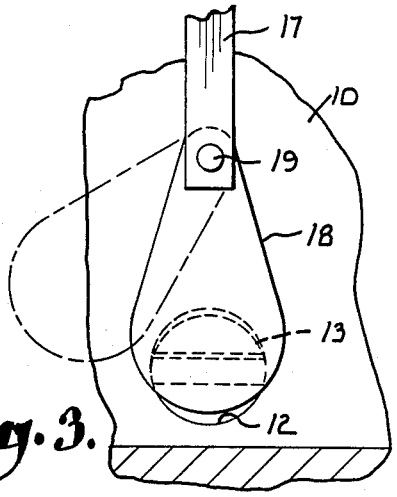
FIG. 3 is a fragmentary view taken generally along 3—3 of FIG. 2 in the direction of the arrows.
Figure 4:
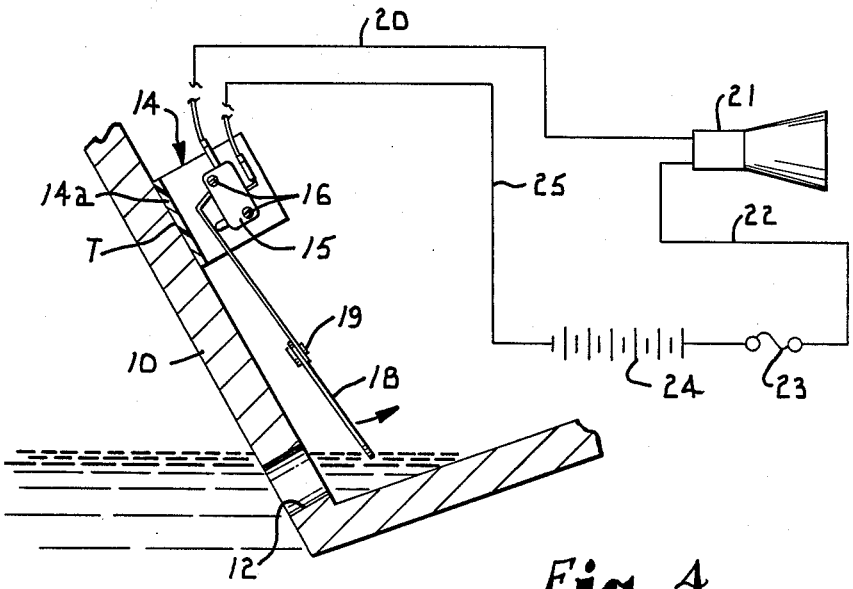
FIG. 4 is a view similar to FIG. 2 but illustrating the configuration of the system for sounding the warning.

Positioned at the lower end of arm 17 and forming an extension thereof is a flat paddle 18 having the generally oval configuration, in plan, illustrated in FIG. 3. The paddle is connected by a rivet 19 or other pin and bearing connection to the end of the arm 17. The connection is such that the paddle can be manually pivoted about the axis of rivet 19 so as to completely clear it from the inside entrance to the drain opening when desired.

The microswitch 15 is located in an electric circuit which includes conductor 20 to an acoustical horn or buzzer 21, conductor 22, fuse 23, DC battery 24 and return conductor 25 to the switch. While not shown, a visual signalling device, such as a flashing lamp, can be included also.

The paddle 18 is preferably made of plastic. As illustrated, it normally is positioned so that it lies closely adjacent the inside end of the drain opening and plug. The paddle overlies the plug and normally blocks removal of the plug. However, it can be swung to one side as illustrated in FIG. 3 to permit access to the plug for removal and for insertion.

When the plug has been removed, the paddle overlies the normal path water would take in flowing through the drain opening into the boat. If the boat is launched under these conditions the water will flow as a stream through the opening and impact the paddle, thus forcing the paddle and arm to deflect and act upon the switch plunger 15*a* to close the switch 15. This closes the circuit to the horn or buzzer, causing an audible warning to be provided which will continue so long as the force of inflowing water is enough to maintain the switch closed under the influence of the paddle.

Water draining from the boat obviously does not cause a warning signal since the paddle and arm are urged toward the "out" position for the switch plunger. However, in this connection it is important to note that the paddle should be so dimensioned and positioned that when reverse flow is occurring, there is enough space left between the bottom edge of the paddle and the adjoining portion of the drain entrance to assure that water flow can take place between the surfaces. We have found that by locating the bottom of the paddle one-quarter inch to three-eighths inches above the bottom of the drain hole adequate drainage is provided.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described our invention, we claim:

1. Apparatus for a boat for sensing and signaling the absence of a drain plug from the boat drain opening as the boat is launched, said apparatus comprising a paddle having a portion positioned adjacent said opening to be engaged and displaced by water flowing through said opening;

means supporting said paddle for movement between a first position and a second position, said second position representing the displaced condition for the paddle;

sensing means for sensing movement of said paddle to said second position; and signal means operated by said sensing means in response to movement of said paddle to said second position to emit a warning signal indicating the absence of a plug in said opening.

2. Apparatus as in claim 1, said means for supporting said paddle including an arm, the paddle being connected with one end of said arm and forming an extension thereof, said paddle disposed generally in the path of water flowing through said drain opening.

3. Apparatus as in claim 2, said paddle normally at least partially blocking the entrance to said opening; and means connecting the paddle to the arm which permits displacement of the paddle to one side of the opening thereby to allow for insertion of a drain plug into the opening.

4. Apparatus as in claim 1, said means supporting said paddle comprising a pivotal arm;

means mounting said arm to the boat;

said signal means associated with said arm and operated in response to pivotal movement of said arm.

5. Apparatus as in claim 2, said paddle so dimensioned and positioned as to provide a passage for water to flow through said opening from inside the boat while the plug is absent thus to permit water to drain from the boat outwardly through said opening.

* * * * *